US006276011B1

(12) United States Patent
Antinori

(10) Patent No.: US 6,276,011 B1
(45) Date of Patent: Aug. 21, 2001

(54) ADJUSTABLE BED AND ADJUSTABLE FRAME THEREFOR

(76) Inventor: Santino Antinori, 4924 St. Croix Dr., Tampa, FL (US) 33629

( * ) Notice: Subject to any disclaimer, the term of this patent is extended or adjusted under 35 U.S.C. 154(b) by 0 days.

(21) Appl. No.: 09/528,445

(22) Filed: Mar. 17, 2000

(51) Int. Cl.[7] ..... A61G 7/06
(52) U.S. Cl. ..... 5/618; 5/613; 5/617
(58) Field of Search ..... 5/616, 618, 613, 5/617

(56) References Cited

U.S. PATENT DOCUMENTS

| | | | | |
|---|---|---|---|---|
| 3,593,350 | * | 7/1971 | Knight | 5/616 |
| 3,821,821 | * | 7/1974 | Burst et al. | 5/616 |
| 4,381,571 | | 5/1983 | Elliott . | |
| 4,385,410 | | 5/1983 | Elliott et al. . | |
| 4,407,030 | | 10/1983 | Elliott . | |
| 5,537,701 | | 7/1996 | Elliott . | |
| 5,577,279 | * | 11/1996 | Foster et al. | 5/617 |
| 5,870,784 | | 2/1999 | Elliott . | |
| 6,006,379 | * | 12/1999 | Hensley | 5/616 |
| 6,088,853 | * | 7/2000 | Jansen | 5/616 |
| 6,101,647 | * | 8/2000 | Stroud et al. | 5/616 |

* cited by examiner

*Primary Examiner*—Michael F. Trettel
(74) *Attorney, Agent, or Firm*—Diller, Ramik & Wight

(57) ABSTRACT

An adjustable bed which includes a first frame and a second slide frame upon and relative to the first frame. The first frame includes side guides along which roll rollers carried by slide rails of the slide frame. The slide frame includes a backrest frame, a seat frame and a thigh/leg frame. The backrest frame is defined by opposite pairs of head arms and back arms transversely connected by crossbars between the head arm and between the back arms. A pair of extendable/retractable members are connected one to each of the crossbars. The extendable/retractable members are relatively extended in a first position in which the backrest frame, seat frame and thigh/leg frames are disposed in a substantially horizontal plane and a second position in which the backrest frame is raised and the seat frame is closer to a head end of the frame. The thigh/leg frame is also defined in part by a pair of legs which are moved between a first position in substantial horizontal relationship and a second position angulated thereto. Extendable and retractable members move the pair of legs between the first and second positions by moving from a retracted position and vice versa.

39 Claims, 4 Drawing Sheets

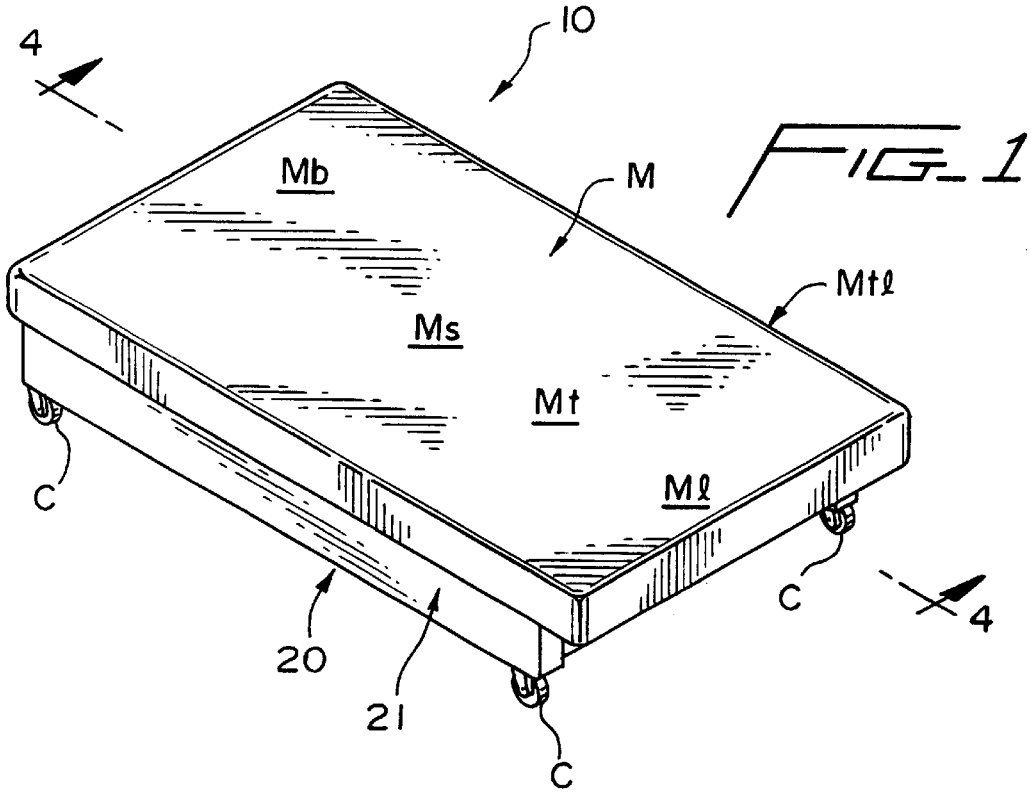
FIG. 1
FIG. 2
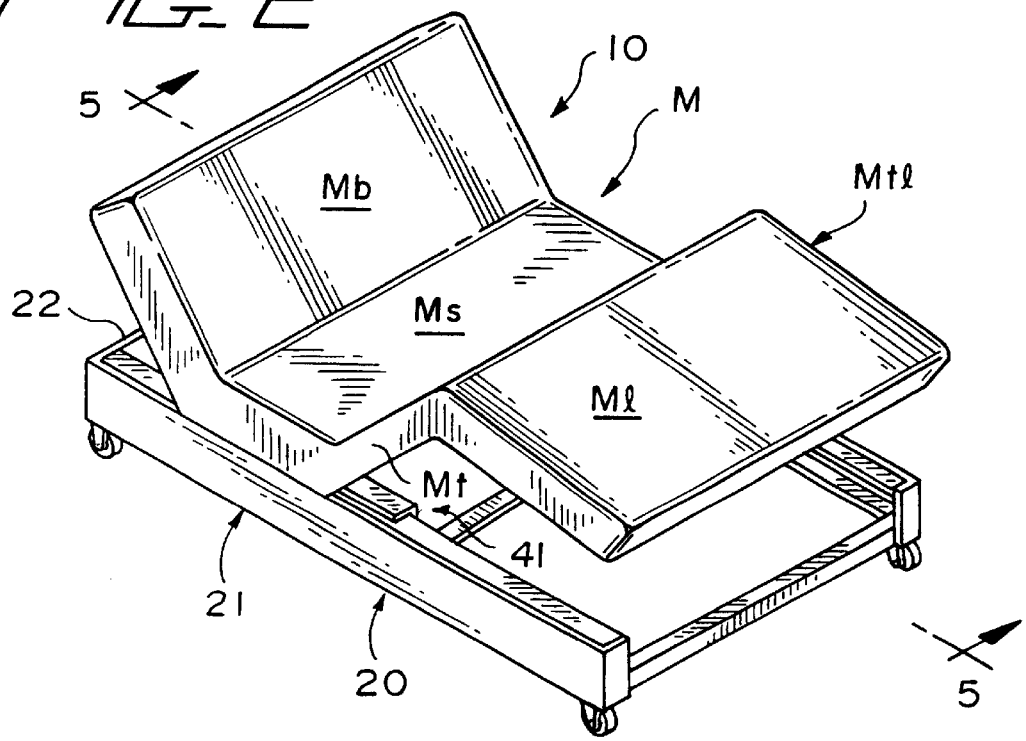

10
Ls
M
Ts
Ss
Bs
E
Mb
V
20
21
22
23
24
25
29
36
37
38
39
41
50
51
52
53
54
55
61
72
73
81
82
84
85
86
92
92'
93
93'
95
95'
96
96'
97
97'
98
98'
101
102
102'
103
104
104'
111
112
113
115

ADJUSTABLE BED AND ADJUSTABLE FRAME THEREFOR

BACKGROUND OF THE INVENTION

The invention is directed to an adjustable bed and specifically an adjustable frame for the bed which is utilized in conjunction with a mattress such that the bed can be adjusted from a substantially horizontal planar position to one of several positions in which a backrest and/or a leg rest or both are adjusted for comfort while a person thereon sleeps, eats, might watch television or is required to spend considerable lengths of time in bed for therapeutic purposes, as might occur should such a person be injured or suffering from physical or mental problems. Typical of such adjustable or articulated beds are those disclosed in U.S. Pat. Nos. 4,381,571; 4,385,410; 4,407,030; 5,537,701 and 5,870,784. As is perhaps best illustrated and disclosed in the latter patent, such articulated beds are extremely complicated in both construction and operation, particularly because of the multiplicity of brackets, linkages, lost motion connections, etc. The complexity of such adjustable beds requires relatively intelligent workers to manufacture, assemble and ship the same, and if not shipped in an operative condition, end users must likewise be relatively intelligent to assemble such adjustable beds from individual unassembled components thereof. Obviously, the more complex the construction of such beds, the greater the costs not only in manufacturing, but also the greater the costs in shipping because of added weight and bulk/size.

SUMMARY OF THE INVENTION

In keeping with the foregoing, a primary object of this invention is to provide an adjustable bed frame which is extremely economical to manufacture due to the construction thereof from a multiplicity of standard components, such as angle irons, channels, etc., which can be readily assembled by unskilled labor in a readily simple and straightforward manner which achieves a relatively lightweight, yet strong construction of a relatively modest size readily accommodated for low-cost shipping and subsequent simplicity in use. The adjustable bed frame preferably includes a backrest frame and a thigh/leg frame, each articulately connected to a seat frame, and all frames being normally disposed in a substantially horizontal first position while being selectively moved to "uptight" second positions for supporting a patient or person upon a mattress in substantially a seated position with the person's back adjustably angled to the horizontal, as might be found necessary or desirable. The thigh/leg frame can be selectively adjusted to, for example, elevate one's legs which is particularly desirable in conjunction with treatment of certain physiological problems particularly associated with the circulatory system. However, persons and patients find laying in a bed with legs elevated to be both comfortable and therapeutic.

A drive assembly is associated with the adjustable back frame and the adjustable thigh/leg frame, and the drive assemblies are essentially identical, as are associated connections and connecting links which further simplifies manufacturing and assembly cost, as well as any subsequent costs of repair. The backrest frame is also pivotally connected to a seat frame such that the drive assembly for articulating the backrest frame also automatically moves the seat frame such that the position of a patient upon the mattress of the associated bed is maintained essentially at the same relationship to bedside facilities, such as tables, benches, chairs or the like, irrespective of the position of the backrest frame or the seat frame. Furthermore, the head portion or head edge of the mattress is basically maintained at the same position relative to a vertical plane in the first and all second positions which allows the bed to be positioned with the head end thereof immediately adjacent a wall of a room and the latter will not interfere with the operation of the bed or the bed frame irrespective of any adjustments rendered thereto.

In further accordance with this invention, electric drive motors are provided, one for moving the thigh/leg frame from a substantially planar first position to an essentially upright second position and a like electric drive mechanism is connected between head arms and back arms of the backrest frame which are pivotally connected to each other and one each to a head end of the frame and to the seat frame. The latter drive mechanism includes relatively extendable and retractable members which are preferably extended in the first substantially horizontally planar position of the backrest and its associated head and back arms whereupon energization and retraction of one of the members relative to the other member effects smooth pulling forces which are applied between the head and back arms resulting in smooth non-jerking movement thereof from the first to the second position with attendant smooth sliding movement of the seat frame.

In further accordance with this invention, the seat frame is preferably part of a slide frame having opposite slide rails carrying rollers which are rollingly supported upon opposite side guides of a first or main support frame of the bed. The side guides preferably include slots or openings through which the rollers can be introduced into or withdrawn from the side guides or guide rails to achieve rapid assembly and disassembly of the slide frame relative to the first or main frame.

The various linkages associated with the backrest frame and the thigh/leg frame are also designed to reduce overall height of the bed frame when in the first position, namely, the position at which all frames of the bed frame, such as the backrest frame, the seat frame, and the thigh/leg frame are in a substantially horizontal position. This allows the bed to be constructed of a conventional height which in turn permits storage thereunder of appropriate objects, such as suitcases, shoes, slippers, etc. absent interference from linkages, drive assemblies, drive motors, etc.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a top perspective view of a novel adjustable bed constructed in accordance with this invention, and illustrates a first or main frame and thereupon a mattress in a substantially horizontally position.

FIG. 2 is a perspective view of the adjustable bed, and illustrates the mattress adjusted to one of many different positions of adjustment by virtue of a sliding frame defined by a seat frame, a backrest frame, and a thigh/leg frame.

DESCRIPTION OF THE PREFERRED EMBODIMENT

Figure 3:
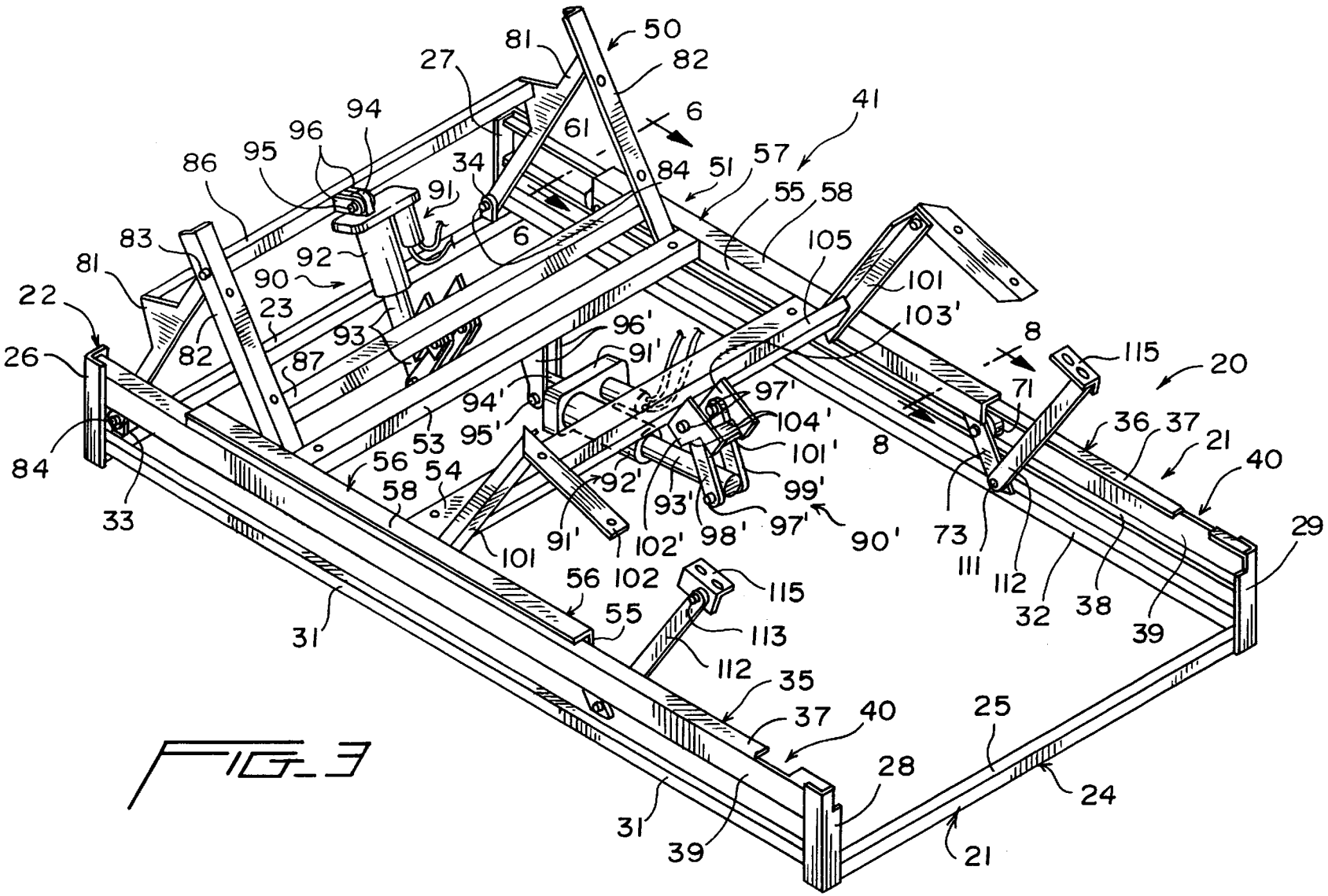
FIG. 3 is a perspective view of the adjustable bed fame of the invention, and illustrates various arms and crossbars of the backrest frame and the thigh/leg frame pivotally connected to each other and to portions of the slide or slide frame; rollers carried by side slide rails of the slide frame associated with guide rails of the first frame; and two extensible and retractable drive mechanisms for selectively moving the backrest frame and the thigh/leg frame between numerous positions of adjustment.

A novel adjustable or articulate bed is illustrated in FIGS. 1, 2, 4 and 5 of the drawings and is generally designated by the reference numeral 10. The adjustable bed 10 includes an adjustable bed frame 20 (FIG. 3) upon which rests a mattress M of a conventional construction, including a backrest mattress portion Mb, a seat mattress portion Ms, a thigh mattress portion Mt, and a leg mattress portion Ml. The mattress M can be moved between the substantially horizontally disposed, flat, uni-planar position of FIG. 1, and the adjusted or articulated position of FIG. 2. Though FIG. 2 illustrates the mattress M with both the backrest mattress portion Mb and the thigh mattress portion Mt and the leg mattress portion Ml adjusted, it is to be understood that in keeping with the invention, as will be set forth fully hereinafter, the backrest mattress portion Mb can be adjusted individually absent adjustment of the thigh mattress portion Mt and the leg mattress portion Ml, the latter two of which move jointly and are collectively referred to as the thigh/leg mattress portion Mtl.

The adjustable bed frame 20 is best illustrated in FIG. 3 of the drawings, and includes a first or main frame 21 and a second frame, slide frame or slide 41.

The first or main frame 21 includes a first frame head end 22 including a head end crossbar 23 of a tubular metallic construction and a first frame foot end 24 which includes a foot end crossbar 25 of a tubular metallic construction. The head end crossbar 23 is welded to lower ends of vertical or upright angle iron corner bars 26, 27 while the foot end cross bar 25 is likewise welded to lower ends (unnumbered) of vertical or upright angle iron corner bars 28, 29 (FIG. 3). Substantially tubular metallic side bars 31, 32 are disposed in substantially parallel relationship, and are welded in spanning relationship to and between the respective corner bars 26, 28 and 27, 29. If desired, casters C (FIGS. 1 and 2), rollers, wheels or the like can be conventionally mounted at each corner bar 26 through 29 to permit the first frame 21 to be relatively mobile.

The head end crossbar 23 includes two upstanding ears or lugs 33, 34 (FIG. 3) which function in a manner to be described more fully hereinafter. A generally C-shaded side guide, rail or track 35, 36 is positioned above, spaced from and generally parallel to the respective side bars 31, 32. The side guide 35 is in spanning relationship between and is welded to the corner bars 26, 28 while the side guide 36 similarly spans between and is welded to the corner bars 27, 29. Each of the side guide 35, 36 includes an upper web or flange 37, a lower web or flange 38 substantially parallel thereto, and a web or bight portion 39 therebetween. The flanges 37, 38 are in opposing substantially parallel relationship to each other. Each of the upper flanges 37 is provided with means 40 in the form of slots or openings through which guide rollers can be introduced into and/or removed from the side guides 35, 36 to a effect assembly and disassembly of the slide frame or slide 41 relative to the first frame 21, as will be described more fully hereinafter.

The slide or slide frame 41 includes a backrest frame 50, a seat rest frame or seat frame 51 and a thigh/leg frame 52.

Figures 4, 5:
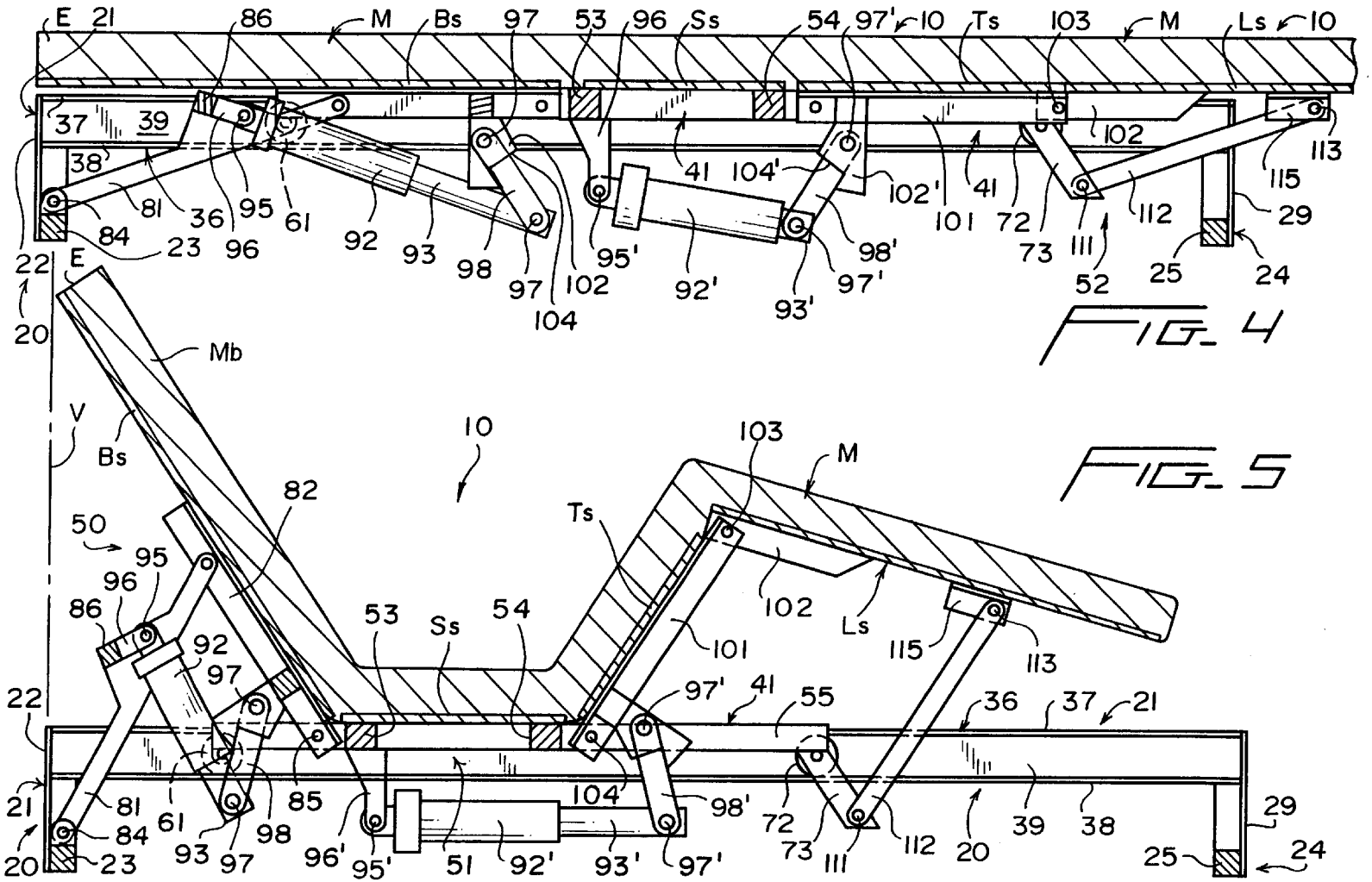
FIG. 4 is a longitudinal cross-sectional view taken generally along line 4—4 of FIG. 1, and illustrates the backrest frame, the seat frame and the thigh/leg frame disposed in a substantially horizontal aligned position.
FIG. 5 is a longitudinal cross-sectional view taken generally along line 5—5 of FIG. 2, and illustrates the backrest frame and the thigh/leg frame each in a second of many different positions of adjustment.
Figure 6:
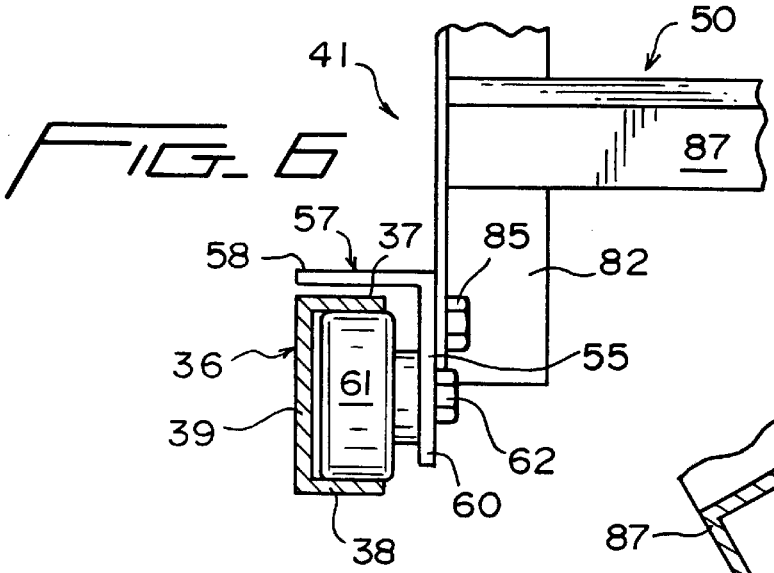
FIG. 6 is an enlarged fragmentary cross-sectional view taken generally along line 6—6 of FIG. 3, and illustrates one of a pair of rollers carried by a side slide rail of the side frame in rolling engagement with a side guide of the first or main frame and a backrest arm pivotally connected to the side slide rail.
Figure 7:
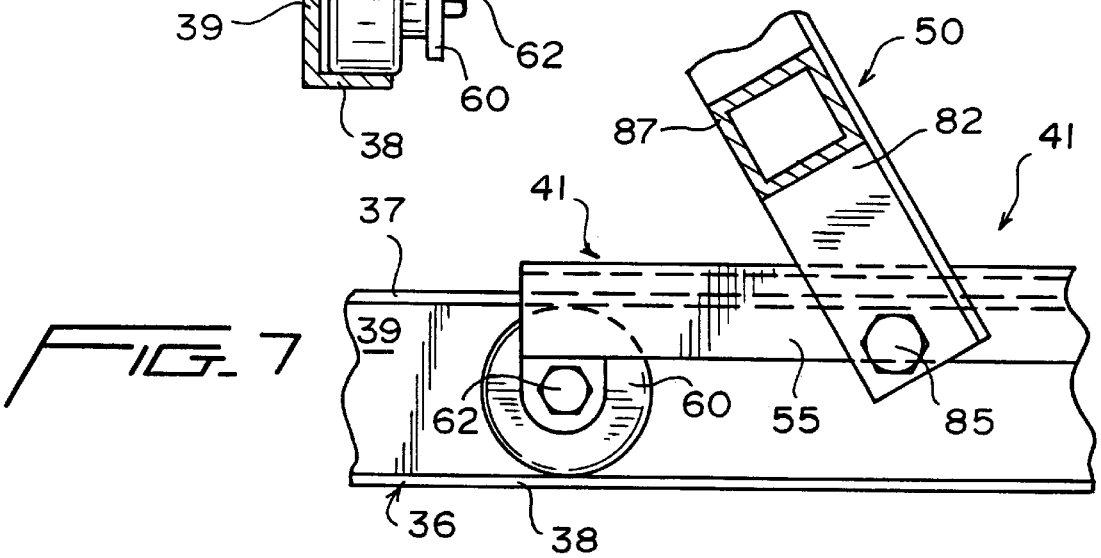
FIG. 7 is a fragmentary side elevational view looking from right-to-left in FIG. 6, and illustrates details of the slide rail and arm.
Figure 8:
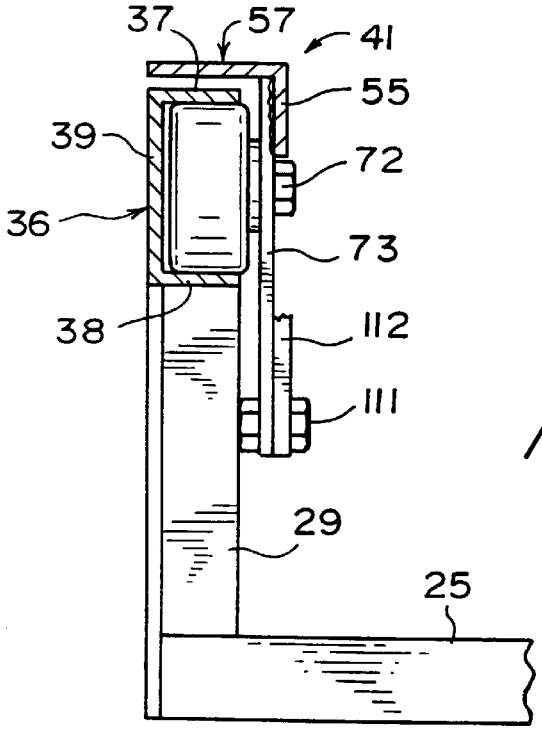
FIG. 8 is an enlarged fragmentary cross-sectional view taken generally along line 8—8 of FIG. 3, and illustrates another roller carried by the side slide rail in rolling contact with the stationary side guide of the first frame.

The seat frame 51 is defined by two substantially parallel tubular metallic seat crossbars 53, 54, each welded at opposite ends thereof to vertical flanges or legs 55 of side slide rails 56, 57 which also include upper horizontally aligned oppositely directed horizontal flanges 58. The ends (unnumbered) of the side slide rails 56, 57 most adjacent the first frame head end 22 include a downwardly projecting lug 60 of each vertical leg 55 (FIGS. 6 and 7) which has conventionally rotatably secured thereto a head end guide roller 61 by a conventional guide roller bolt 62. At the foot end (unnumbered) of each side slide rail 56, 57, a foot end guide roller 71 (FIG. 8) is rotatably mounted by a guide roller bolt 72 to an arm 73 in part defining the thigh/leg frame 52, as will be described more fully hereinafter. The arm or leg arm 73 is welded to each of the vertical legs or flanges 55 of each of the side slide rails 56, 57. As is best illustrated in FIGS. 3 through 5 of the drawings, the rollers 61, 61 at the head end, and the rollers 72, 72 at the foot end of the slide rails 56, 57 roll along the flanges 38 which effects reciprocal sliding movement of the slide frame 41 between the positions shown in FIGS. 4 and 5 of the drawings. Furthermore, during assembly/disassembly of the overall slide frame 41 and prior to the connection of drive motors/lift motors thereto or the removal thereof therefrom, the rollers 61, 71 can be inserted into and removed from the opening means or guide roller entrance and exit slots 40 (FIG. 3) in the upper flanges or legs 37 of the side guides 57, 58 to permit rapid assembly and disassembly of the slide frame or slide 41 relative to the first or main frame 21.

The backrest frame 50 includes two pair of identical arms, namely, a head arm 81 and a backrest arm 82, the latter of which is a piece of angle iron. First ends (unnumbered) of the head end arm or head arm 81 and the backrest arm or back arm 82 are pivotally interconnected by first pivot means 83 in the form of a conventional pivot pin. Second pivot means 84 connect the head arms 81 to the lugs 33, 34 of the crossbar 23, while third pivot means 85 (FIGS. 3 and 4) connect each back arm 82 to the vertical leg 55 of the adjacent slide rail 56, 57. A head arm crossbar 86 of tubular metallic material spans and is welded to the head arms 81, 81 and a backrest cross arm 87 of tubular metallic material spans and is welded to the back arms 82, 82 of the backrest frame 50.

A backrest frame and slide frame drive assembly is generally designated by the reference numeral 90 and includes a lift motor or drive motor 91 of a conventional construction. The drive motor or drive means 91 is electrically driven from a conventional source under the control of conventional switches and includes relatively expandable and contractible tubular members 92, 93, the latter of which is telescopically received in the former. The member 92 includes a flange 94 which is connected by a pivot pin 95 to a pair of lugs 96 welded to the head crossbar 86. The member 93 is pivoted by a pivot pin 97 to a pair of links 98, 99 which are in turn rigidly connected to each other by a metallic web 101 welded therebetween. The arms or links 98, 99 are received between brackets 102, 103, each of which is notched to define an abutment edge 104. Opposite ends of the brackets 102, 103 are welded to the crossbar 87.

As is best illustrated in FIG. 4 of the drawings, the members 92, 93 are in their fully extended position when the backrest frame 50 lies in a substantially horizontal plane and when the motor (unnumbered) of the drive mechanism 91 is energized, the member 93 is pulled into the member 92 which both pulls the entire slide frame 41 from the position shown in FIG. 4 to the position shown in FIG. 3, while simultaneously the arms 81, 82 are pulled toward each other progressively decreasing the angle from 180° (FIG. 4) to any one of a variety of different angles therebetween at which the backrest frame 50 is in a substantially upright position (FIG. 5). Inasmuch as the drive motor 91 must pull the entire slide frame 41 from the position shown in FIG. 4 to that shown in FIG. 5 and simultaneously draw the arms 81, 82 to an angular orientation therebetween, considerably high torque is necessary to achieve the latter, and such is accommodated by the pulling motion which effects the latter movements in a smooth jerk-free manner.

The adjustable thigh/leg frame 52 includes a pair of opposite angle-iron thigh arms 101 and opposite angle-iron leg arms 102 with the latter arms being pivotally connected by pivot means or a pivot 103 in a conventional manner. Each thigh arm 101 is also pivotally connected by conventional pivot means or a pivot 104 (FIG. 5) to the adjacent vertical leg 55 of the adjacent side slide rails 56, 57. The arms 101, 101 are also bridged by a tubular metallic thigh crossbar 105 appropriately welded thereto. Also welded to the thigh crossbar 105 are brackets 102', 103' corresponding to the brackets 102, 103, earlier described with respect to the backrest frame and slide frame drive assembly 90. In the instant description, the brackets 102', 103' are part of a thigh/leg frame drive assembly 90' which includes a drive motor 91' and other components, including extensible and retractable members 92', 93' which are identically numbered and primed because of the identity thereof in structure and function to the backrest frame and slide frame drive assembly 90 heretofore described. A flange or bracket 94' is housed between lugs 96', 96' and is pivotally connected thereto by a pivot pin 95'. The lugs 96', 96' are welded to the seat frame crossbar 53. The drive means 91' is, of course, an electrically driven drive mechanism which includes the extendable and retractable members 92', 93' which in the horizontal position (FIG. 4) of the various frames are retracted relative to each other. However, upon energization of the electric motor of the drive mechanism or lift mechanism 91', the member 93' is pushed/extended outwardly from the member 92' which pivots the thigh arms 101 about the pivot pins 104 and thereby moves the thigh arms 101 and the leg arms 102 from the position shown in FIG. 4 to and through various adjusted positions, including the position shown in FIG. 5. However, in addition to the thigh arms 101 and the leg arms 102, the thigh/leg frame 52 includes the arms 73 heretofore described which for purposes of description are considered leg arms to which are each connected by conventional pivot means or pivot pins 111, a leg arm 112 which in turn is each connected by a pivot 113 (FIGS. 4 and 5) to an angle bracket or terminal leg arm 115. A leg support Ls (FIG. 5), such as a sheet of plywood, spans the arms 102, 115 transversely across the slide frame 41 and is appropriately secured by screws or the like to the arms 102, 102, 115 and 115. The leg support Ls is relatively thin but rigid material and functions to support thereatop the mattress leg portion Ml. In a similar manner, a relatively thin thigh support Ts, such as a sheet of plywood, spans and is secured to the thigh arms 101, 101; a seat support Ss similarly spans and is secured to the seat cross bars 53, 54 and a backrest support Bs spans and is secured to the backrest arms 82, 82. The latter backrest, seat, thigh and leg supports Bs, Ss, Ts and Ls, respectively, assure support of the mattress M and the associated mattress portions in the manner evident from FIG. 5 of the drawings.

As opposed to the drive mechanism 90 which is extended in FIGS. 1 and 4, the drive mechanism 91' is retracted in this same position, namely, the position in which all of the frames 50, 51, 52 are substantially in planar horizontal relationship. Thus, the drive mechanism 91' is operated to extend the members 92', 93' relative to each other under a pushing force during movement of the components from the position shown in FIG. 4 to the position shown in FIG. 5. and vice versa. The latter pushing force is adequate to achieve smooth non-jerking motion of the thigh/leg frame 52 from the position shown in FIG. 4 to the position shown in FIG. 5 because a relatively lesser load is placed thereupon as compared to the load placed upon the drive mechanism/lift motor 90 when energized in the position shown in FIG. 4 to both not only lift the backrest frame 50 but also draw the entire slide frame 41 from right-to-left, as viewed in FIGS. 4 and 5 of the drawings. It is also to be noted in the latter figures, that an uppermost edge E of the backrest mattress portion Mb lies closely adjacent to a vertical plane VB, such as a wall, and this permits a person essentially the same access to items to the left or right of the bed 10 irrespective of the position of the slide frame 41.

Although a preferred embodiment of the invention has been specifically illustrated and described herein, it is to be understood that minor variations may be made in the apparatus without departing from the spirit and scope of the invention, as defined the appended claims.

What is claimed is:

1. An adjustable bed frame comprising a first frame having substantially remote frame head and frame foot ends, a slide frame mounted for reciprocal sliding movement relative to said first frame, said slide frame including opposite side slide rails each having opposite head and foot ends, a backrest frame adjacent said first frame head end, said backrest frame including at least one pair of head and back arms, first pivot means for pivotally connecting first ends of said head and back arms to each other, second pivot means for pivotally connecting a second end of said head arm to said first frame head end, third pivot means for pivotally connecting a second end of said back arm to at least one of the side slide rail head ends, a backrest frame and slide frame drive assembly for simultaneously moving said backrest frame and slide frame from a first substantially aligned horizontal first position to a second position at which said slide frame is closer to said frame head end than when in said first position and said backrest frame is at least partially raised, and said drive assembly including drive means connected between said head and back arms for pulling said head and back arms from a substantially horizontal planar 180° position relative to each other in said first position to the second position at which said head and back arms define a relatively acute angle therebetween in said second position and reversing movement from said second position to said first position by pushing said head and back arms relative to each other.

2. The adjustable bed frame as defined in claim 1 including a thigh/leg frame adjacent said first frame foot end, said thigh/leg frame including a pair of thigh and leg arms, fourth pivot means for pivotally connecting a first end of said thigh arm to said slide frame and fifth pivot means for pivotally connecting a second end of said thigh arm to a first end of said leg arm, a thigh/leg frame drive assembly for moving said thigh/leg frame from a first position at which said pair of thigh and leg arms are substantially horizontally aligned and a second position at which said thigh and leg arms are at least partially raised, and said thigh/leg drive assembly including drive means connected between said slide frame and said thigh arm.

3. The adjustable bed frame as defined in claim 1 including a thigh/leg frame adjacent said first frame foot end, said thigh/leg frame including a pair of thigh and leg arms, fourth pivot means for pivotally connecting a first end of said thigh arm to said slide frame and fifth pivot means for pivotally connecting a second end of said thigh arm to a first end of said leg arm, a thigh/leg frame drive assembly for moving said thigh/leg frame from a first position at which said pair of thigh and leg arms are substantially horizontally aligned and a second position at which said thigh and leg arms are at least partially raised, said thigh/leg drive assembly including drive means connected between said slide frame and said thigh arm, said thigh/leg drive assembly drive means being constructed and arranged to push said thigh and leg arms from said first substantially horizontally aligned position to said second position and pull said thigh and leg arms from said second position to said first position.

4. The adjustable bed frame as defined in claim 1 including a second pair of head and back arms, a crossbar between said head arms and a crossbar between said back arms, and said backrest frame and slide frame drive assembly drive means being connected between said crossbars.

5. The adjustable bed frame as defined in claim 1 including a second pair of head and back arms, a crossbar between said head arms and a crossbar between said back arms, said backrest frame and slide frame drive assembly drive means being connected between said crossbars, said backrest frame and slide frame drive assembly drive means including a pair of relatively driven extendable and retractable members, said extendable and retractable members having opposite remote ends, and said remote ends being pivotally connected one to each of said crossbars.

6. The adjustable bed frame as defined in claim 1 including a second pair of head and back arms, a crossbar between said head arms and a crossbar between said back arms, said backrest frame and slide frame drive assembly drive means being connected between said crossbars, said backrest frame and slide frame drive assembly drive means including a pair of relatively driven extendable and retractable members, said extendable and retractable members having opposite remote ends, said remote ends being pivotally connected one to each of said crossbars, and said extendable and retractable member being relatively extended in said first position and retracted in said second position.

7. The adjustable bed frame as defined in claim 1 wherein said backrest frame and slide frame drive assembly drive means includes a pair of relatively driven extendable and retractable members, and said extendable and retractable members are relatively extended in said first position and retracted in said second position.

8. The adjustable bed frame as defined in claim 2 including a second pair of head and back arms, a crossbar between said head arms and a crossbar between said back arms, and said backrest frame and slide frame drive assembly drive means being connected between said crossbars.

9. The adjustable bed frame as defined in claim 2 including a second pair of head and back arms, a crossbar between said head arms and a crossbar between said back arms, said backrest frame and slide frame drive assembly drive means being connected between said crossbars, said backrest frame and slide frame drive assembly drive means including a pair of relatively driven extendable and retractable members, said extendable and retractable members having opposite remote ends, and said remote ends being pivotally connected one to each of said crossbars.

10. The adjustable bed frame as defined in claim 2 including a second pair of head and back arms, a crossbar between said head arms and a crossbar between said back arms, said backrest frame and slide frame drive assembly drive means being connected between said crossbars, said backrest frame and slide frame drive assembly drive means including a pair of relatively driven extendable and retractable members, said extendable and retractable members having opposite remote ends, said remote ends being pivotally connected one to each of said crossbars, and said extendable and retractable member being relatively extended in said first position and retracted in said second position.

11. The adjustable bed frame as defined in claim 2 wherein said backrest frame and slide frame drive assembly drive means includes a pair of relatively driven extendable and retractable members, and said extendable and retractable members are relatively extended in said first position and retracted in said second position.

12. The adjustable bed as defined in claim 2 wherein said thigh/leg drive assembly drive means includes a pair of relatively driven extendable and retractable members, and said extendable and retractable members are relatively extended in said second position of said thigh/leg frame and retracted in said first position of said thigh/leg frame.

13. The adjustable bed as defined in claim 3 wherein said thigh/leg drive assembly drive means includes a pair of relatively driven extendable and retractable members, and said extendable and retractable members are relatively extended in said second position of said thigh/leg frame and retracted in said first position of said thigh/leg frame.

14. The adjustable bed frame as defined in claim 3 including a second pair of head and back arms, a crossbar between said head arms and a crossbar between said back arms, and said backrest frame and slide frame drive assembly drive means being connected between said crossbars.

15. The adjustable bed frame as defined in claim 12 including a second pair of head and back arms, a crossbar between said head arms and a crossbar between said back arms, and said backrest frame and slide frame drive assembly drive means being connected between said crossbars.

16. The adjustable bed frame as defined in claim 13 including a second pair of head and back arms, a crossbar between said head arms and a crossbar between said back arms, and said backrest frame and slide frame drive assembly drive means being connected between said crossbars.

17. An adjustable bed frame comprising a first frame having substantially remote first frame head and frame foot ends and a pair of opposite substantially parallel side guides therebetween, a slide frame mounted for reciprocal sliding movement relative to said first frame, at least a pair of rollers between each side guide and said slide frame, each said pair of rollers including a head end roller and a foot end roller carried by said slide frame, said side guides including a rail having upper and lower flanges upon the latter of which said rollers are adapted to roll to effect reciprocal sliding movement of said slide frame relative to said first frame, and opening means in each of said upper flanges through which said rollers pass to assemble and/or disassemble said slide frame relative to said side guides.

18. The adjustable bed frame as defined in claim 17 wherein said opening means is an opening in each upper flange, and said openings are in transversely aligned relationship.

19. The adjustable bed frame as defined in claim 17 wherein said rails are each of a substantially C-shaped transverse cross-section configuration with the flanges disposed in transversely opposing relationship to each other.

20. The adjustable bed frame as defined in claim 17 wherein said rollers are supported in rolling relationship upon said lower flanges.

21. The adjustable bed as defined in claim 17 wherein said slide frame includes a pair of opposite substantially parallel side slide rails with each slide rail being adjacent and substantially parallel to a side guide, said slide rails and side guides each having a head end and a foot end adjacent said respective first frame head and frame foot ends, and said rollers being carried one at each of said slide rail head and foot ends.

22. The adjustable bed as defined in claim 17 wherein said slide frame includes a pair of opposite substantially parallel side slide rails with each slide rail being adjacent and substantially parallel to a side guide, said slide rails and side guides each having a head end and a foot end adjacent said respective first frame head and frame foot ends, said rollers being carried one at each of said slide rail head and foot ends, a pair of foot support arms at each slide rail foot end, a first of each pair of foot support arms being fixed to an associated slide rail foot end, a second of each pair of foot support arms being pivotally connected by pivot means to one of said first foot support arm, and each said second foot support arms being adapted for connection to a foot support.

23. The adjustable bed as defined in claim 17 wherein said slide frame includes a pair of opposite substantially parallel side slide rails with each slide rail being adjacent and substantially parallel to a side guide, said slide rails and side guides each having a head end and a foot end adjacent said respective first frame head and frame foot ends, said rollers being carried one at each of said slide rail head and foot ends, a pair of foot support arms at each slide rail foot end, a first of each pair of foot support arms being fixed to an associated slide rail foot end, a second of each pair of foot support arms being pivotally connected by pivot means to one of said first foot support arm, each said second foot support arms being adapted for connection to a foot support, and a foot support bridging and connected to said second foot support arms.

24. The adjustable bed as defined in claim 17 wherein said slide frame includes a pair of opposite substantially parallel side slide rails with each slide rail being adjacent and substantially parallel to a side guide, said slide rails and side guides each having a head end and a foot end adjacent said respective first frame head and frame foot ends, said rollers being carried one at each of said slide rail head and foot ends, a pair of foot support arms at each slide rail foot end, a first of each pair of foot support arms being fixed to an associated slide rail foot end, a second of each pair of foot support arms being pivotally connected by pivot means to one of said first foot support arm, each said second foot support arms being adapted for connection to a foot support, a foot support bridging and connected to said second foot support arms, a pair of thigh support arms each pivoted to one of said slide rails between the ends thereof, a thigh support bridging and connected to said thigh support arms, means for pivotally connecting said thigh support to said foot support, and means for pivoting said thigh support arms between a first position substantially in parallel aligned relationship with said slide rails and a second position angulated relative thereto.

25. The adjustable bed as defined in claim 17 wherein said slide frame includes a pair of opposite substantially parallel side slide rails with each slide rail being adjacent and substantially parallel to a side guide, said slide rails and side guides each having a head end and a foot end adjacent said respective first frame head and frame foot ends, said rollers being carried one at each of said slide rail head and foot ends, a pair of foot support arms at each slide rail foot end, a first of each pair of foot support arms being fixed to an associated slide rail foot end, a second of each pair of foot support arms being pivotally connected by pivot means to one of said first foot support arm, each said second foot support arms being adapted for connection to a foot support, a foot support bridging and connected to said second foot support arms, a pair of thigh support arms each pivoted to one of said slide rails between the ends thereof, a thigh support bridging and connected to said thigh support arms, means for pivotally connecting said thigh support to said foot support, means for pivoting said thigh support arms between a first position substantially in parallel aligned relationship with said slide rails and a second position angulated relative thereto, a first crossbar bridging and connected to said thigh support arms, a second crossbar bridging and connected to said slide rails, and said pivoting means including extendable and retractable members disposed between and connected one to each of said cross bars.

26. The adjustable bed as defined in claim 17 wherein said slide frame includes a pair of opposite substantially parallel side slide rails with each slide rail being adjacent and substantially parallel to a side guide, said slide rails and side guides each having a head end and a foot end adjacent said respective first frame head and frame foot ends, said rollers being carried one at each of said slide rail head and foot ends, a pair of foot support arms at each slide rail foot end, a first of each pair of foot support arms being fixed to an associated slide rail foot end, a second of each pair of foot support arms being pivotally connected by pivot means to one of said first foot support arm, each said second foot support arms being adapted for connection to a foot support, a foot support bridging and connected to said second foot support arms, a pair of thigh support arms each pivoted to one of said slide rails between the ends thereof, a thigh support bridging and connected to said thigh support arms, means for pivotally connecting said thigh support to said foot support, means for pivoting said thigh support arms between a first position substantially in parallel aligned relationship with said slide rails and a second position angulated relative thereto, a first crossbar bridging and connected to said thigh support arms, a second crossbar bridging and connected to said slide rails, said pivoting means including extendable and retractable members disposed between and connected one to each of said cross bars, and said extendable and retractable members are in retracted relationship in said thigh support arms first position.

27. An adjustable bed frame comprising a first frame having substantially remote frame head and frame foot ends and substantially parallel transversely spaced side guides, a slide frame having substantially parallel transversely spaced side slide rails disposed one adjacent each side guide, roller means for effecting rolling support between said slide rails and side guides, a backrest frame adjacent said first frame head and a thigh/leg frame adjacent said frame foot end, said backrest frame including a head arm and a back arm, first pivot means for pivotally connecting first ends of said head and back arms to each other, second pivot means for pivotally connecting second ends of said head arm to said first frame head end, third pivot means for pivotally connecting a second end of said back arm to a head end of at least one of the slide rails, a backrest frame and slide frame drive assembly for simultaneously moving said backrest frame and slide frame from a substantially aligned horizontal first position to a second position at which said slide frame is closer to said first frame head end than when in said first position and said backrest frame is at least partially raised, said drive assembly including drive means connected between said head arm and said back arm, said drive means including relatively extendable and retractable members which are in substantially extended relationship in said first position and in substantially retracted relationship in said second position, said thigh/leg frame including a thigh arm and a leg arm, fourth pivot means for pivotally connecting first ends of said thigh arm and leg arm to each other, fifth pivot means for pivotally connecting a second end of said thigh arm to a foot end of at least one of said slide rails, a thigh/leg frame drive assembly for simultaneously moving said thigh/leg frame from a substantially aligned horizontal first position to a second position at which said thigh/leg frame is at least partially raised, said thigh/leg frame drive assembly including drive means connected between said slide frame and said thigh arm, and said last-mentioned drive means including relatively extendable and retractable members which are in substantially retracted relationship in said thigh/leg frame first position and in substantially extended relationship in said thigh/leg frame second position.

28. The adjustable bed as defined in claim 27 wherein said head arm and back arm are arranged in a pair associated with each slide rail, a crossbar connected to and spanning said pair of head arms and said pair of back arms, and said first-mentioned extendable and retractable members are connected in spanning relationship to and between said crossbars.

29. The adjustable bed as defined in claim 27 wherein said thigh arm and leg arm are arranged in a pair associated with each slide rail, a cross bar connected to and spanning said pair of thigh arms, and said last-mentioned extendable and retractable members are connected to and between said last-mentioned crossbar and said slide frame.

30. The adjustable bed as defined in claim 27 wherein said roller means are a pair of rollers carried by each slide rail.

31. The adjustable bed as defined in claim 27 wherein said roller means are a pair of rollers carried by each slide rail, and each pair of rollers being substantially confined within an associated side guide.

32. The adjustable bed as defined in claim 27 wherein said roller means are a pair of rollers carried by each slide rail, each pair of rollers being substantially confined within an associated side guide, and opening means each side guide for introducing said rollers into and removing said rollers from said side guides to effect respective assembly and disassembly of said slide frame relative to said first frame.

33. The adjustable bed as defined in claim 28 wherein said thigh arm and leg arm are arranged in a pair associated with each slide rail, a cross bar connected to and spanning said pair of thigh arms, and said last-mentioned extendable and retractable members are connected to and between said last-mentioned crossbar and said slide frame.

34. The adjustable bed as defined in claim 28 wherein said roller means are a pair of rollers carried by each slide rail.

35. The adjustable bed as defined in claim 28 wherein said roller means are a pair of rollers carried by each slide rail, and each pair of rollers being substantially confined within an associated side guide.

36. The adjustable bed as defined in claim 28 wherein said roller means are a pair of rollers carried by each slide rail, each pair of rollers being substantially confined within an associated side guide, and opening means in each side guide for introducing said rollers into and removing said rollers from said side guides to effect respective assembly and disassembly of said slide frame relative to said first frame.

37. The adjustable bed as defined in claim 33 wherein said roller means are a pair of rollers carried by each slide rail.

38. The adjustable bed as defined in claim 33 wherein said roller means are a pair of rollers carried by each slide rail, and each pair of rollers being substantially confined within an associated side guide.

39. The adjustable bed as defined in claim 33 wherein said roller means are a pair of rollers carried by each slide rail, each pair of rollers being substantially confined within an associated side guide, and opening means in each side guide for introducing said rollers into and removing said rollers from said side guides to effect respective assembly and disassembly of said slide frame relative to said first frame.

* * * * *